United States Patent [19]

Mercier et al.

[11] 4,047,541

[45] Sept. 13, 1977

[54] SHOWER HEAD LIQUID DISPENSER

[76] Inventors: Julien Mercier, 4181-45th Street, Apt. 6, Montreal, Quebec; Real Mercier, Terrebonne County, Mascouche; Raymond Mercier, St. Anselme de Dorchester, all of Canada

[21] Appl. No.: 677,349

[22] Filed: Apr. 15, 1976

[51] Int. Cl.[2] ..... E03B 7/07

[52] U.S. Cl. ..... 137/564.5; 239/313; 239/322; 251/6

[58] Field of Search ..... 222/389, 395; 239/313, 239/317, 322; 137/564.5; 251/6

[56] References Cited

U.S. PATENT DOCUMENTS

| | | | |
|---|---|---|---|
| 2,206,089 | 7/1940 | Gray | 137/564.5 X |
| 2,323,618 | 7/1943 | Ottoson | 239/322 X |
| 3,135,259 | 6/1964 | Evans | 251/6 X |
| 3,166,096 | 1/1965 | Lang | 137/564.5 |

*Primary Examiner*—Robert B. Reeves

*Assistant Examiner*—John P. Shannon

[57] ABSTRACT

A liquid dispenser connectable between a shower pipe and a shower head to automatically dispense soap or bath oil through the shower head. This shower head liquid dispenser includes a tubular body connecting at opposite ends to the shower pipe and the shower head respectively to form a direct path for water and including an upstream section of smaller transverse cross-section and a downstream section of larger transverse cross-section. The smaller upstream section is provided with a lateral outlet; the larger downstream section is provided with a lateral inlet; a soap or bath oil reservoir is removably screwed to the lateral outlet; a flexible tube connects the reservoir to the lateral inlet and forms a second liquid path with the reservoir; and a piston and spring combination is mounted in the reservoir to expel the soap or bath oil from the reservoir in response to a pressure differential on the piston and to return the latter to an inoperative position under the biasing action of the spring upon disappearance of the pressure differential.

1 Claim, 2 Drawing Figures

SHOWER HEAD LIQUID DISPENSER

This invention relates to a liquid dispenser of the type which is connected to the shower pipe and shower head to dispense liquid soap or bath oil through the shower head.

It is a general object of the present invention to provide a shower head liquid dispenser of the above type, which is of simple construction and low cost, automatic oeration, easy to refill with liquid soap or bath oil and which avoids wastage of the selected liquid.

It is another object of the present invention to provide a shower head liquid dispenser of the above type, which simply uses a pressure differential along a water supply pipe to expel soap or bath oil from a reservoir to the shower head.

It is a more specific object of the present invention to provide a shower head liquid dispenser of the above type and, as aforementioned, wherein a piston and spring combination swiftly interrups the dispensing of the selected liquid and return the piston to inoperative position to avoid wastage of the liquid and to allow easy refill of the reservoir.

Figure 1:
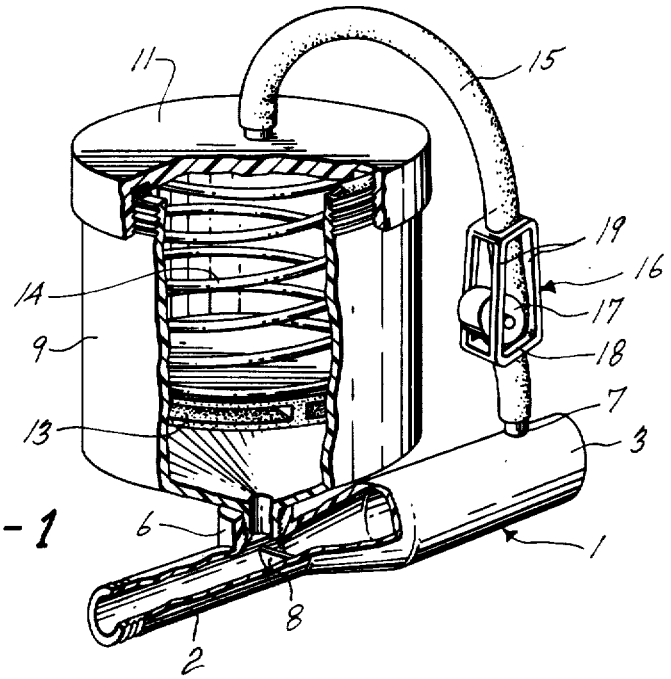
Figure 2:
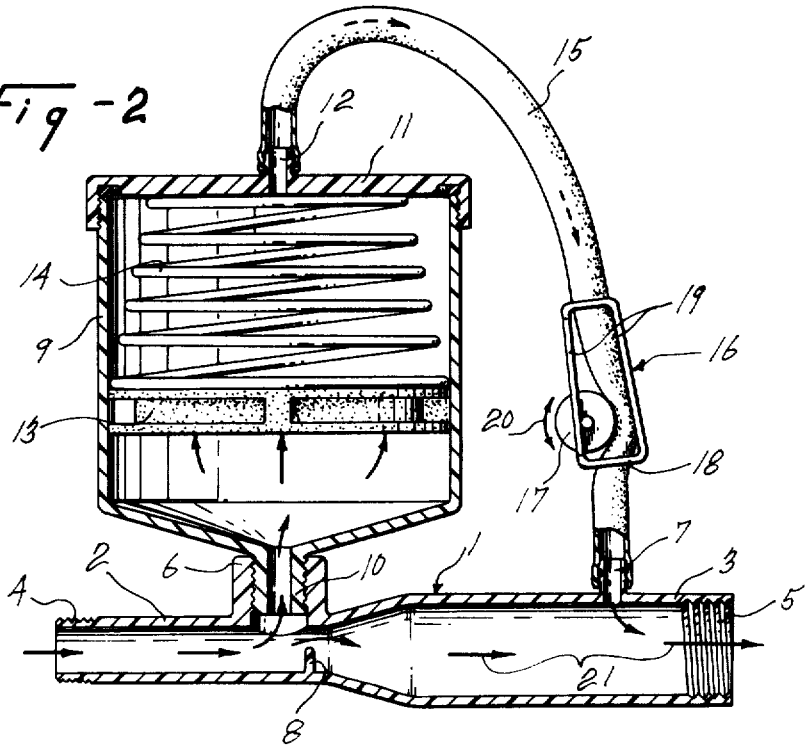

The above and other objects and advantages of the present invention will be better understood in the light of the following detailed description thereof which is illustrated, by way of example, in the accompanying drawings, in which:

FIG. 1 is a perspective view of a shower head liquid dispenser with parts broken away and in accordance with the present invention; and FIG. 2 is a cross-sectional elevation view of the shower head liquid dispenser of FIG. 1.

The illustrated shower head liquid dispenser includes a tubular member or body 1 having an upstream section 2 of relatively smaller transverse cross-section and a downstream section 3 of relatively larger transverse cross-section. this tubular body defines a path for the passage of water from the externally threaded upstream end 4 to the internally threaded downstream end 5. Thus, this tubular body is adapted to be connected to the shower pipe at the end 4 and to the shower head at the end 5. The upstream section 2 of the tubular body is formed with a lateral outlet 6, while the downstream section of the tubular body is formed with a lateral liquid inlet 7.

A lip 8 projects transversely into the liquid path defined by the tubular body 1 downstream of the lateral liquid outlet 6, such as to regulate the pressure upstream thereof at a relatively higher value than in the larger downstream section 3.

A cylindrical tank, or reservoir 9, is provided with a neck 10 which is screwed in the lateral outlet 6 to mount the resevoir upright on the tubular body 1. The reservoir 9 is provided with a screwable cover 11 formed with an outlet 12. A piston 13 is displaceable up and down in the reservoir 9 and has opposite bottom and top faces. A spring 14 is engaged in the reservoir 9 between the top face of the piston 13 and the removable cover 11. Thus, the spring 14 downwardly biases the piston 13 toward an inoperative position against the pressure differential between the upstream section 2 and the downstream section 3.

A flexible tube 15 is connected at one end to the outlet 12 in the cover 11, and at the other end to the lateral inlet 7 of the downstream section 3. A pinch cock 16 is connected to the flexible tube 15 to regualte the flow of soap, bath oil or other dispensable liquid through this tube. The pinch cock simply includes a roller 17 and a support 18 having opposite sides 19 converging toward each other, such that rolling of the roller 17, as shown by the arrows 20 in FIG. 2, will either increase or decrease pinching of the tube 15.

Thus, the reservoir 9 and the flexible tube 15 are connected to each other and to the lateral outlet 6 and lateral inlet 7, respectively, to form a second flow path through these elements.

As the water flows in the tubular body 1 in the direction of the arrows 21 in FIG. 2, a pressure differential is created between the lateral outlet 6 and the lateral inlet 7. The pressure differential is caused by the different diameters of the sections 2 and 3 and by the lip 8. Thus, the higher pressure acts against the bottom face of piston 13; that is, in the upstream path section of the second path. The lower pressure acts against the top face of the piston 13; that is, in the downstream path section of the second path. When the pressure differential exceeds the action of the spring 14, the soap or bath oil above the piston in the reservoir is expelled through the tube 15 and the lateral inlet 7 to be dispensed at the shower head together with the water passing in the tubular body 1.

What we claim is:

1. A shower head liquid dispenser comprising a tubular body forming a first liquid path extending from end to end of the tubular body and having an upstream portion of relatively smaller cross-section and a downstream portion of relatively larger cross-section, a liquid flow restricting internal lip projecting transversely of the tubular body into the first liquid path and located intermediate the upstream portion and the downstream portion of the tubular body, a lateral liquid outlet and a lateral liquid inlet communicating with said upstream and downstream portions, respectively, a liquid reservior having a neck at oen end removably screwed on said lateral outlet and a removable cover in fluid-tight engagement with the other end of said liquid reservoir, a flexible tube having one end in communication with the inside of said reservoir through said cover and having its other end connected to said lateral liquid inlet, said lateral outlet, reservoir, flexible tube and lateral inlet forming a second liquid path, a piston displaceable in the liquid reservoir and dividing the second liquid path into an upstream path section and a downstream path section in open communication with the lateral outlet and lateral inlet, respectively, a compression sring mounted in said reservoir between said piston and said cover and biasing said piston towards said lateral outlet and away from said cover, a pinch cock secured to said flexible tube to regulate the flow of liquid therethrough, said pinch cock including a roller and a support for the roller for adjustable pinching of the latter against said tube upon rolling of the roller along the support, so constructed and arranged that the flow of liquid along said first path produces relatively higher liquid pressure in the upstream path portion than in the downstream path portion of said tubular body which displaces the piston against the action of said spring to expel a liquid in the downstream section of the reservoir through the downstream section back into said tubular body through said lateral inlet.

* * * * *